United States Patent [19]

Szczesny

[11] Patent Number: 4,950,177

[45] Date of Patent: Aug. 21, 1990

[54] CONNECTOR FOR HIGH DENSITY RIBBON CABLE

[76] Inventor: David S. Szczesny, 7572 Morningstar Ave., Harrisburg, Pa. 17112

[21] Appl. No.: 302,102

[22] Filed: Jan. 24, 1989

Related U.S. Application Data

[63] Continuation of Ser. No. 110,624, Oct. 13, 1987, abandoned, which is a continuation of Ser. No. 845,087, Mar. 27, 1986, abandoned.

[51] Int. Cl.[5] ..... H01R 4/24

[52] U.S. Cl. ..... 439/404; 439/405

[58] Field of Search ..... 439/389–410, 439/417, 418, 419, 422, 443, 492–499

[56] References Cited

U.S. PATENT DOCUMENTS

| | | | |
|---|---|---|---|
| 3,444,506 | 5/1969 | Wedekind | 339/99 R |
| 4,026,625 | 5/1977 | Roiko et al. | 339/99 R |
| 4,367,004 | 1/1983 | Fujiura et al. | 339/99 R |
| 4,381,132 | 4/1983 | Tournier | 339/99 R |
| 4,439,001 | 3/1984 | Curley et al. | 339/98 |
| 4,564,254 | 1/1986 | van Alst | 439/404 |
| 4,641,903 | 2/1987 | Anhalt et al. | 439/404 |
| 4,682,835 | 7/1987 | Aujla et al. | 439/395 |

FOREIGN PATENT DOCUMENTS

| | | | |
|---|---|---|---|
| 0003185 | 1/1977 | Japan | 339/99 R |

OTHER PUBLICATIONS

Mass Termination of 25 Mil Planar Cable w/Micro D Connectors, published by Michall K. Cabourne.

*Primary Examiner*—David L. Pirlot

[57] ABSTRACT

Connector for terminating ribbon cable having conductors on close centerline spacing employs slotted plate terminals having conductor receiving portions in staggered relationship at the cable receiving face of the connector. Each conductor receiving portion has substantially parallel outer sheared edge surfaces spaced as the conductors in the cable. Outer sheared edge surfaces of a transition portion diverge through arcs toward a wider base portion which imparts strength to the conductor receiving portion.

12 Claims, 2 Drawing Sheets

CONNECTOR FOR HIGH DENSITY RIBBON CABLE

This application is a continuation of application Ser. No. 110,624 filed Oct. 13, 1987, now abandoned, which is a continuation of application Ser. No. 845,087 filed Mar. 27, 1986, now abandoned.

BACKGROUND OF THE INVENTION

The present invention relates to a connector for insulation displacing termination of ribbon cable having conductors on close centerline spacing and particularly a cable with conductors on 25 mil center.

Connectors for insulation displacing termination of ribbon cable are well known. These generally employ a housing having a mating face, an opposed cable receiving face, and at least two rows of terminal receiving passages extending between said faces. A plurality of stamped and formed metal terminals are received in respective passages, each terminal having major rolled surfaces and sheared edge surfaces, each terminal having a mating portion toward said mating face and a slotted plate toward said cable receiving face.

The slotted plate behaves like two parallel beams. For a given force at a given point on a beam, the deflection is a function of the width, thickness, and properties of the material. As contacts become smaller, these dimensions must be balanced carefully to attain a desired force/deflection ratio. A 10% decrease in beam width can necessitate a 37% increase in material thickness to retain the same force/deflection ratio. Simply using a thicker or stronger material may lead to difficulties in stamping and forming a terminal of the desired configuration. Thus, as the centerline spacing of ribbon cable has decreased, connector design problems have arisen.

A Microminiature D Connector has recently been developed by ITT Cannon Electric for mass terminating ribbon cable with 30 gage wire conductors on 25 mil centers. See Cabourne, Michael K. "Mass Termination of 25 Mil Planar Cable with Micro D Connectors", a paper presented at the 17th Annual Connectors and Interconnection Technology Symposium in Anaheim, Calif. The disclosed connector has slotted plate terminals each with a conductor receiving portion extending above the cable receiving face and a base portion in a respective passage. The conductor receiving portion extends to a pair of insulation piercing points and mutually opposed outer sheared edge surfaces which extend from respective points as diverging straight lines toward the base portion. The base portion likewise has mutually opposed outer sheared edge surfaces which diverge as straight lines, which straight lines are colinear with the outer edge surfaces of the conductor receiving portion. This yields a tapered beam design which provides a normal contact force of about 2½ pounds on a 30 gage stranded wire received in the conductor receiving portion. However, the outer sheared edge surfaces at the level of wire termination are considerably wider than the centerline spacing of the cable, with result that insulation of neighboring adjacent wires is displaced. Thus, while desired contact force is achieved, the possibility of short circuiting between conductors is introduced.

SUMMARY OF THE INVENTION

According to the invention, therefore, a connector is provided with slotted plate terminals having conductor receiving portions with mutually opposed outer sheared edge surfaces spaced approximately as the centerline spacing of the conductors. The base portion has mutually opposed outer sheared edge surfaces which are spaced substantially greater than the conductors. A transition portion between the conductor receiving portion and the base portion comprises outer sheared edge surfaces which diverge through arcs from respective outer sheared edge surfaces of the conductor receiving portion to respective outer sheared edge surfaces of the base portion.

The wide base portion and transition portion impart considerable strength to the narrow conductor receiving portion, so that desirable normal contact force can be achieved without encroaching upon the insulation of neighboring conductors.

DETAILED DESCRIPTION OF THE PREFERRED EMBODIMENT

Figures 1A, 1B, 1C:
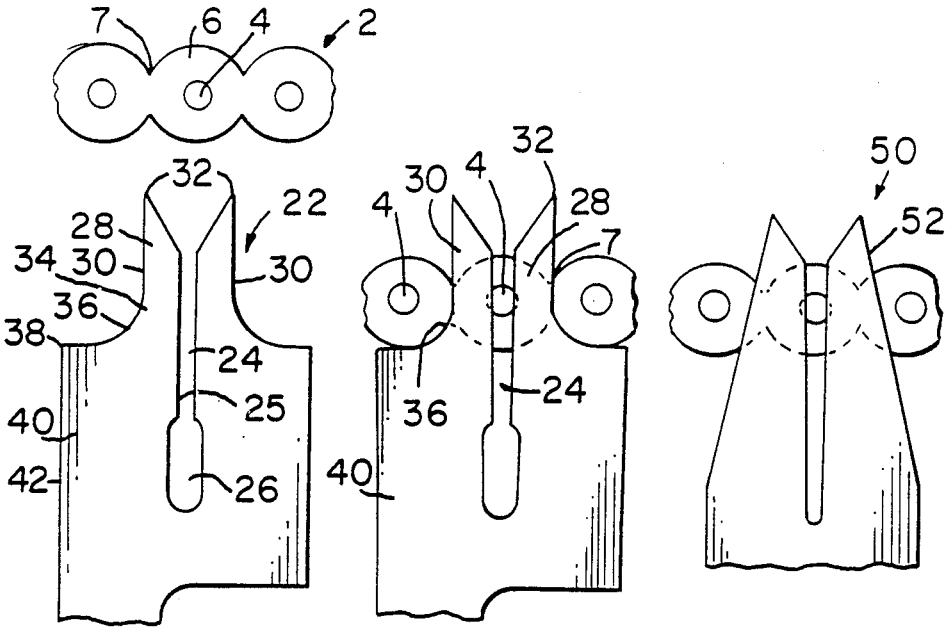
FIG. 1A is a schematic of the terminal prior to termination.
FIG. 1B is a schematic of the terminal after termination.
FIG. 1C is a schematic of the prior art terminal after termination.

Referring to FIG. 1A, the terminal 20 of the present invention is shown prior to terminating a ribbon cable 2 having solid conductors 4 on 25 mil centers in an insulation jacket 6 of predetermined thickness. The jacket 6 has flutes 7 which are likewise on 25 mil centers. The terminal 20 is equally suitable for ribbon cable having stranded conductors and comprises a slotted plate 22 have a slot 24 defined by inner sheared edge surfaces 25, the bottom 26 being enlarged for more uniform stress distribution. The plate 22 has a conductor receiving portion 28, a transition portion 34, and a base portion 40. The conductor receiving portion 28 is defined by mutually opposed substantially parallel outer sheared edge surfaces 30 spaced 25 mils apart and extending to respective insulation piercing points 32 which are likewise spaced 25 mils apart. The transition portion 34 is defined by mutually opposed outer sheared edge surfaces 36 which diverge arcuately from surfaces 30 to corners 38. The base 40 comprises mutually opposed substantially parallel outer sheared edge surfaces 42 which extend from corners 38, which are 65 mils apart.

FIG. 1B shows a conductor 4 received in slot 24, the points 32 being received in the centers of flutes 7 so that the insulation on adjacent conductors 4 rest on arcuate edge surfaces 36 without being displaced by the edge surfaces 30. Ribbon cable 2 has been moved downward from points 32 toward base portion 40 to a final termination position which defines a conductor termination position of conductor 4 within slot 24 where the insulation of adjacent conductors is received on edge surface 36 of transition portion 34. Edge surfaces 36 of transition portion 34 accommodate the insulation of adjacent conductors and diverge from surfaces 30 widening to form base portion 40 as close to the conductor termination position as possible. The conductor receiving portion 28 maintains normal contact force by virtue of strength imparted by base plate 40, in contrast to the tapered design of the prior art terminal 50 shown in FIG. 1C. Here the outer edges 52 are tapered between the conductor receiving portion and the base and thus achieve the desired normal contact force. However, the edges 52 at the level of termination are nearly 40 mils apart as terminated, and thus displace insulation on neighboring conductors as shown.

Figure 2:
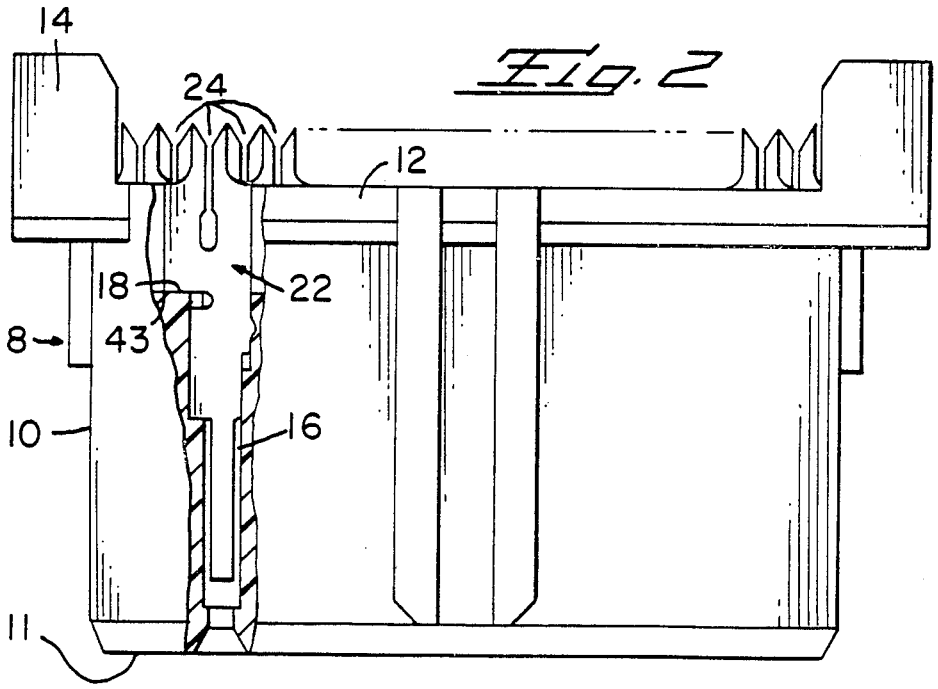
FIG. 2 is a cutaway side view of the connector.
Figure 3:
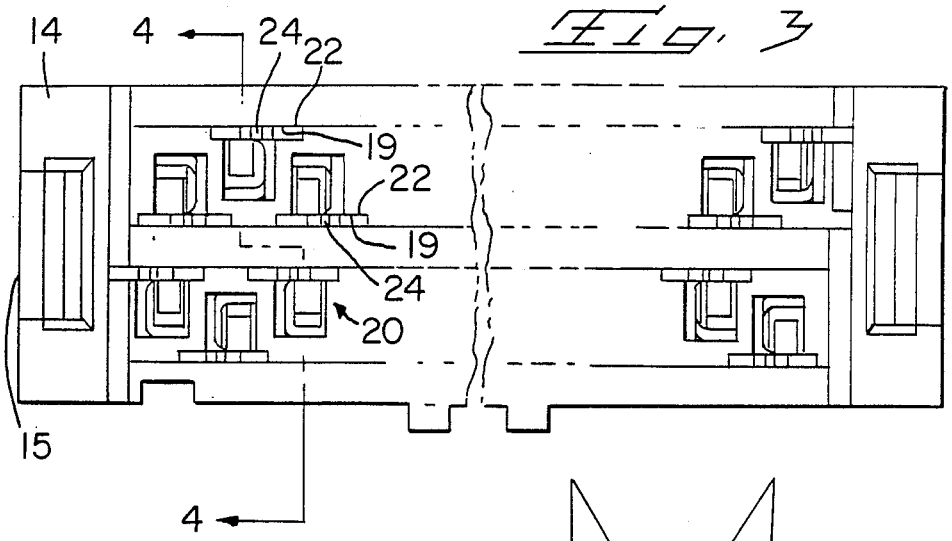
FIG. 3 is a plan view of the connector.
Figure 4:
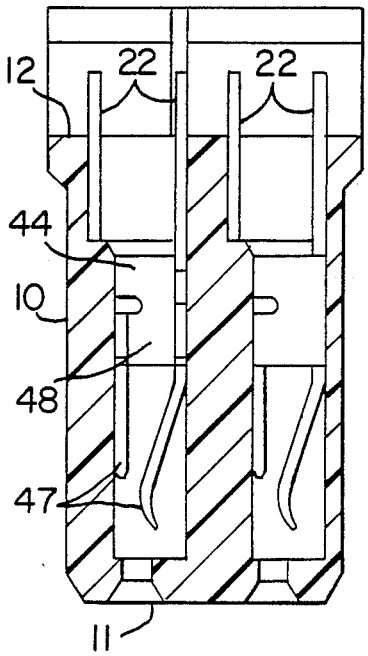
FIG. 4 is an end section of the connector.

Referring to FIGS. 2, 3, and 4, the connector 8 comprises a molded dielectric housing 10 having a mating face 11, an opposed cable receiving face 12, and two rows of cable receiving passages 16 extending therebetween. Adjacent passages in each row have slots 19 on opposite sides thereof, the slots 19 receiving plates 22 so that slots 24 are spaced on 50 mil centers in each row, and 25 mil centers overall. The upright 14 assist in aligning the cable and have webs 15 for cover latches of the type described in U.S. application Ser. No. 778,095. Note that terminals 20 are formed in left and right-handed versions from identical stampings to achieve the offsets shown. Each terminal 20 includes a stamped corner 43 which rests on a should 18 in passage 16 to axially position the terminal and provide support for the slotted plate 22 during termination. The slotted plate 22 is connected to the mating end 46 by an intermediate portion 44. The mating end 46 comprises a pair of arms 47 connected by web 48 which is formed through two ninety degree angles so that a rolled surface is formed to mutually facing relation on adjacent arms. The preferred material is 0.008 thick beryllium copper.

Figure 5:
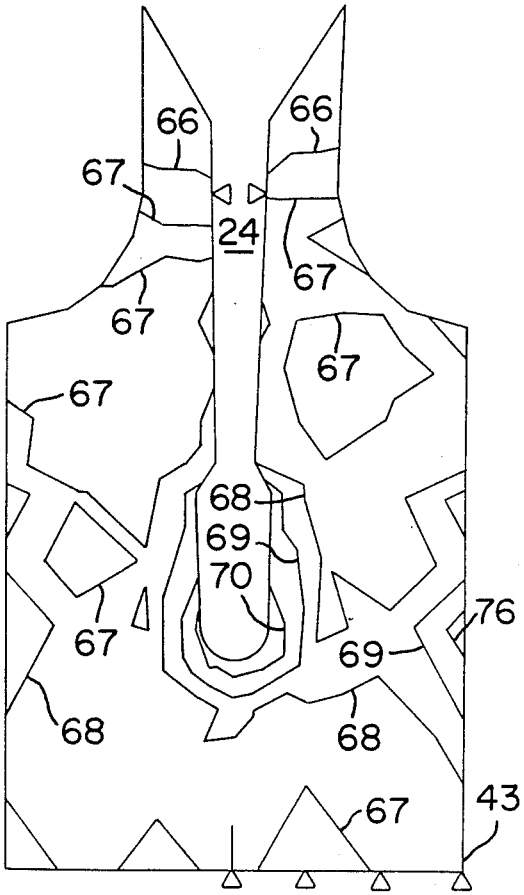
FIG. 5 is a diagrammatic view of the stress distribution in the slotted plate.

FIG. 5 is a stress distribution plot generated by a computer using finite element analysis. The plot represents a 30 gage solid conductor received in slot 24, which expands from 0.005 inch to 0.008 inch. The constraint at corner 43 represents shoulder 18 (FIG. 2). Internal isobars 66 to 70 represent stresses as follows:

| | | |
|---|---|---|
| 66 | 20998 | psi |
| 67 | 40946 | psi |
| 68 | 60894 | psi |
| 69 | 80842 | psi |
| 70 | 100790 | psi |

The foregoing description is exemplary and not intended to limit the scope of the claims which follow.

I claim:

1. An electrical connector for insulation displacing termination of ribbon cable having conductors on predetermined close centerline spacing comprising:

a housing having a mating face, an opposed cable receiving face, and at least one row of terminal receiving passages extending between said faces, a plurality of terminals received in respective passages, each terminal having a mating portion toward said mating face and a slotted plate toward said cable receiving face, said slotted plate comprising a conductor receiving portion, a base portion and a transition portion therebetween, said plate having a conductor receiving slot of selected depth passing through said conductor receiving portion and said transition portion and into said base portion, said conductor receiving portion extending beyond said cable receiving face and having mutually opposed outer edge surfaces which are spaced approximately as the predetermined centerline spacing of the conductors of the ribbon cable adapted to be terminated thereto, said base portion being wider than the conductor receiving portion and having mutually opposed outer edge surfaces which are spaced substantially greater than the predetermined centerline spacing of the conductors of the ribbon cable adapted to be terminated thereto, said base portion beginning approximately midway along the slot depth, said transition portion comprising outer edge surfaces which diverge from respective outer edge surfaces of said conductor receiving portion to respective outer edge surface of said base portion, at least a portion of the transition region extending above the cable receiving face, said transition portion adapted to receive on the diverging edges thereof an outer surface of insulation surrounding conductors adjacent to a conductor received in a respective slotted plate when a ribbon cable is terminated in the connector, whereby that portion of the transition region extending above the cable receiving face receives on the diverging edges thereof an outer surface of insulation surrounding adjacent conductors in the cable and normal contact force is maintained on a conductor received in the slot by strength imparted from said base portion when a ribbon cable is terminated to the connector.

2. An electrical connector for insulation displacing termination of ribbon cable having conductors on close centerline spacing as recited in claim 1 wherein the conductors are spaced on 25 mil centers.

3. An electrical connector as in claim 1 wherein said outer sheared edge surfaces of said transition portion diverge through arcs.

4. An electrical connector as in claim 1 wherein said outer sheared edge surfaces of said conductor receiving portion are substantially parallel.

5. An electrical connector as in claim 4 wherein said outer sheared edge surfaces of said conductor receiving portion extend to a pair of insulation piercing points remote from said cable receiving face, said points likewise being spaced as said conductors in said cable.

6. An electrical connector as in claim 3 wherein said arcs are generally quartercircular and have radii approximately one-half the conductor centerline spacing.

7. An electrical connector as in claim 6 wherein said arcs are approximately ninety degrees quartercircular arcs, said outer sheared edge surfaces of said base portion being at least twice as far apart as the outer sheared edge surfaces of said conductor receiving portion.

8. An electrical connector as in claim 7 wherein the quartercircular arcs have a common tangent, said common tangent being substantially coplanar with said cable receiving face.

9. An electrical connector as in claim 1 wherein said conductor centerline spacing is 25 mils, said mutually opposed outer sheared edge surfaces of said conductor receiving portion being about 25 mils.

10. An electrical connector as in claim 9 wherein said outer sheared edge surfaces of said base portion are spaced 65 mils apart.

11. An electrical connector as in claim 1 wherein said slotted plates lie in four rows, staggered between rows, the plates in each row having four times the centerline spacing of the conductors.

12. An electrical connector as in claim 11 wherein the mating portions of the terminals lie in two rows, the mating portions in each row having twice the centerline spacing of the conductors.

* * * * *